United States Patent [19]

Myers

[11] 4,444,451

[45] Apr. 24, 1984

[54] MODULAR PLUG-DUAL MODULAR JACK ADAPTOR

[75] Inventor: Ronald W. Myers, Landisburg, Pa.

[73] Assignee: AMP Incorporated, Harrisburg, Pa.

[21] Appl. No.: 354,974

[22] Filed: Mar. 5, 1982

[51] Int. Cl.[3] ..... H01R 13/506; H01R 13/514

[52] U.S. Cl. ..... 339/154 A; 339/159 R; 339/176 M

[58] Field of Search ..... 339/154 A, 159 R, 176 M

[56] References Cited

U.S. PATENT DOCUMENTS

| | | | |
|---|---|---|---|
| 4,061,411 | 12/1977 | Gumb et al. | 339/159 R |
| 4,153,327 | 5/1979 | Johnson | 339/205 |
| 4,241,974 | 12/1980 | Hardesty | 339/154 A |
| 4,273,402 | 6/1981 | Hughes | 339/91 R |
| 4,295,702 | 10/1981 | Snyder | 339/97 P |
| 4,315,664 | 2/1982 | Hughes et al. | 339/176 M |
| 4,362,905 | 12/1982 | Ismail | 179/1 PC |

*Primary Examiner*—Eugene F. Desmond

*Attorney, Agent, or Firm*—Katherine A. Nelson; F. W. Raring

[57] ABSTRACT

A modular plug-dual modular jack adaptor is disclosed. The adaptor is comprised of a two piece molded housing having a plurality of one piece uninsulated conductor members therein, which can engage directly with the contacts in other modular jacks and plugs. The conductor members are made from stamped and formed sheet metal or wire. The adaptor is intended to provide multiple jack access at a single jack location.

10 Claims, 6 Drawing Figures

MODULAR PLUG-DUAL MODULAR JACK ADAPTOR

FIELD OF THE INVENTION

This invention relates to electrical connectors of the type adapted to connect a modular jack to multiple modular plugs.

BACKGROUND OF THE INVENTION

Modular jacks and modular plugs for telephones are well known. There are situations, however, in the field of tele-communications, where it is desirable to connect two pieces of telephone equipment at one location in parallel with a telephone line at the same location, U.S. Pat. No. 4,295,702 discloses in detail a multi-outlet adaptor for plug-in telephones intended to provide multiple jack access at a single jack location. The adaptor as described in that patent is comprised of a two piece insulating housing, a series of blade contacts for piercing the insulated wire, and a series of insulated wire conductors terminated at both ends with wire spring contacts.

The present invention is directed to the achievement of an adaptor of the general type as disclosed in U.S. Pat. No. 4,295,702, but having a plurality of one piece uninsulated conductor members which results in fewer parts, greater reliability, lower assembly cost, and other advantages as discussed below.

An important feature of the invention disclosed herein is that it requires tooling for only three different parts, two housing pieces, and the conductor members. The interlocking housing pieces are molded from nylon using straight action molding. The uninsulated one piece conductor members can be stamped and formed from sheet metal. The conductors, therefore, can be made automatically and quickly, thus reducing manufacturing costs. The use of only three different pieces and straight action molding also lower the cost of manufacturing and the assembly time required for each adaptor.

PREFERRED EMBODIMENT OF THE INVENTION

Figure 1:
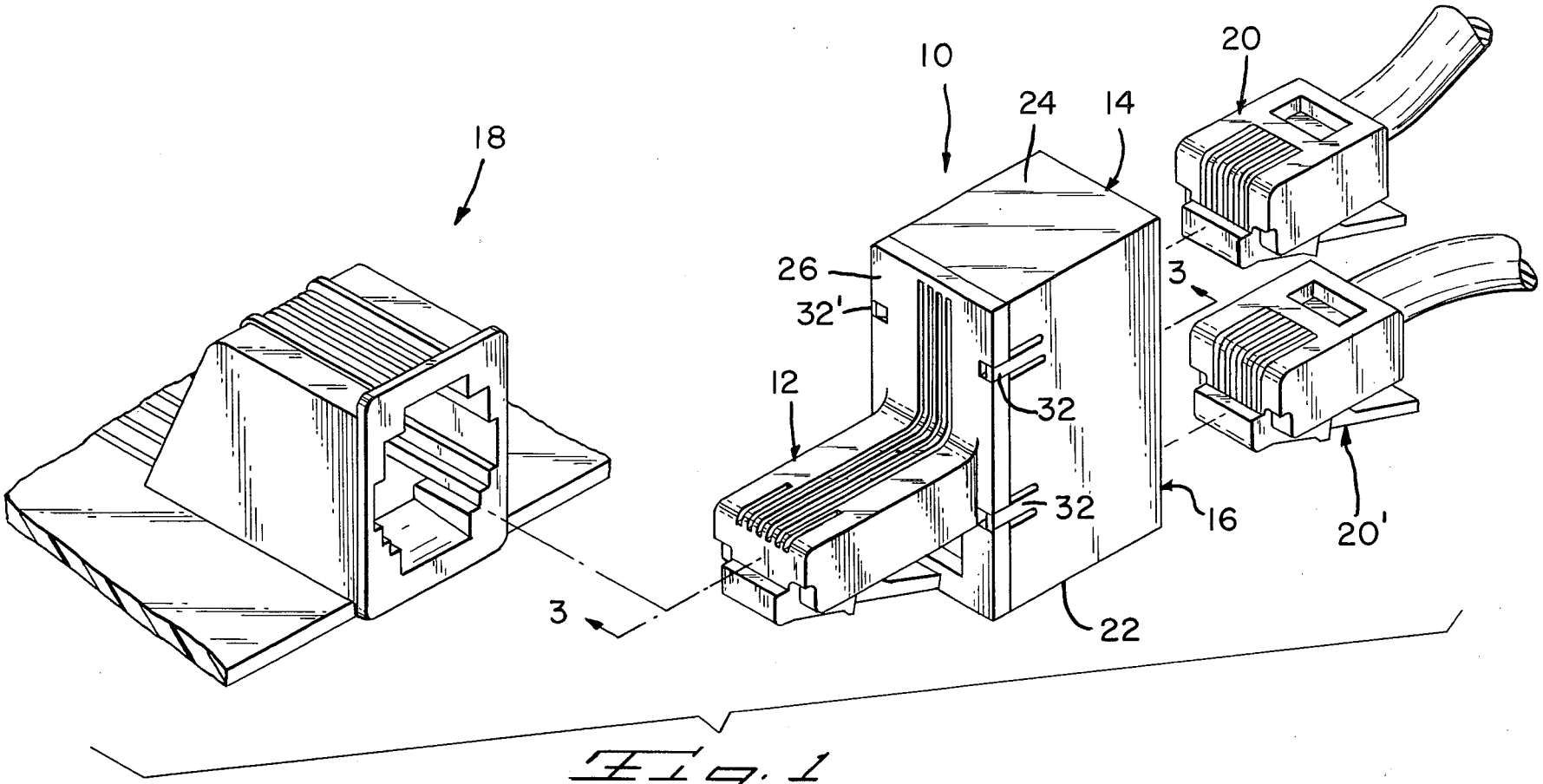
FIG. 1 is a perspective view of the modular plug-dual modular jack adaptor illustrating its intended use as an adaptor to connect one modular jack to two modular plugs.

Referring to FIG. 1, a modular-plug dual modular jack adaptor 10 having a modular plug 12, a first modular jack 14 and a second modular jack 16 is intended for use with an additional modular jack 18 and additional modular plugs 20 and 20'. When the modular plug 12 is mated with the modular jack 18, and modular plugs 20 and 20' are plugged into modular jacks 14 and 16, the conductors in the additional modular jack 18 are connected to the corresponding conductors in the additional modular plugs 20 and 20'.

Figure 2:
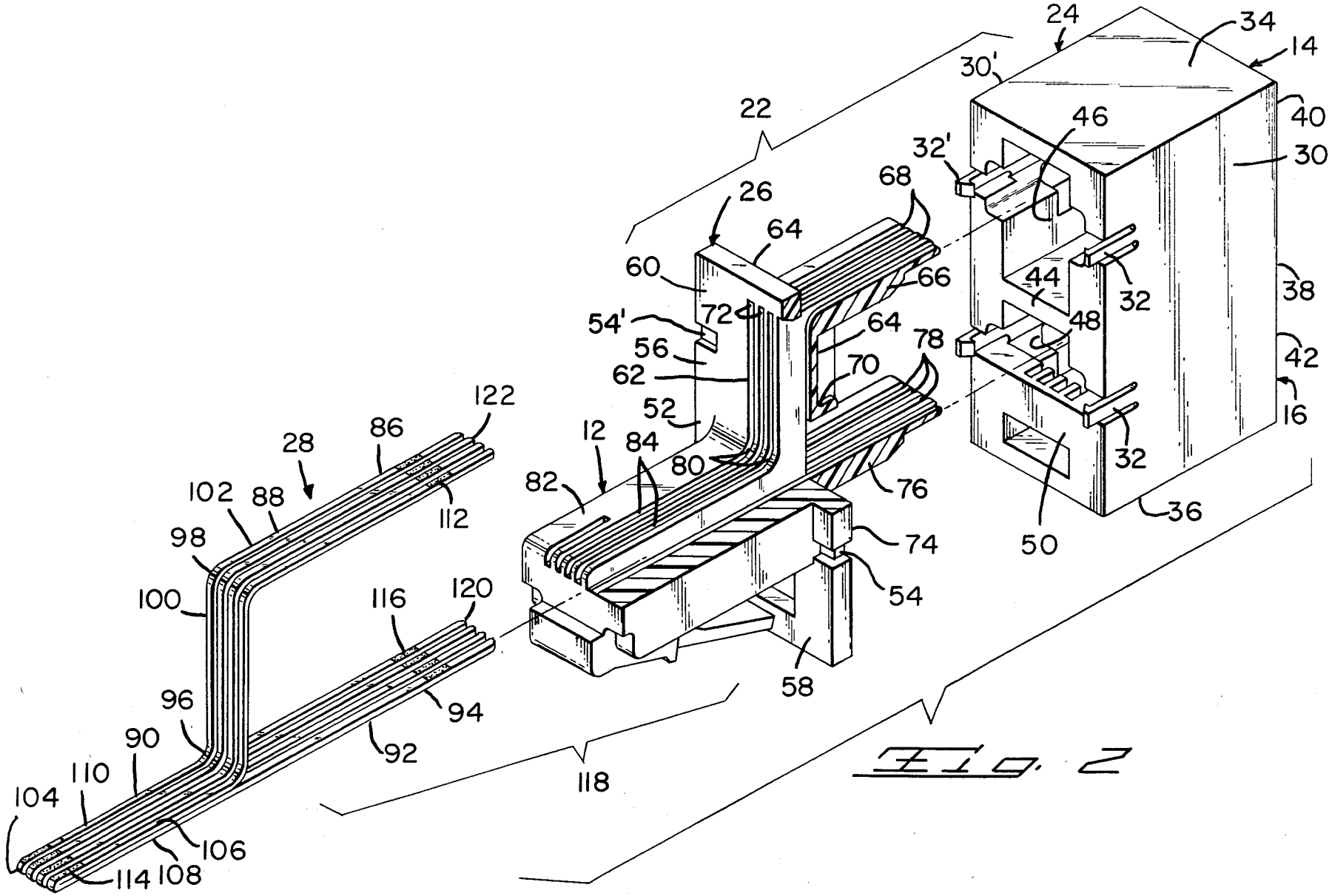
FIG. 2 is a perspective view of the adaptor with the parts exploded from one another.

Referring now to FIG. 2, the adaptor 10 is comprised of a two piece insulated housing 22 having a jack portion 24 and a plug portion 26 and a plurality of conductor members 28.

The jack portion 24 of the housing 22 is comprised of oppositely facing sidewalls 30 and 30' having locking shoulders 32 and 32' therein; an upper endwall 34, a lower endwall 36 and a front wall 38 having a first plug-receiving face 40 and a second plug-receiving face 42 therein. The jack section 24 further has an internal wall 44, parallel to the endwalls 34 and 36, which divides the jack section 24 into a first modular jack cavity 46 and second modular jack cavity 48 and an inner support wall 50 in the second cavity 48 that is parallel to and separated from the front wall 38.

The plug portion 26 is comprised of the backwall 52 of the jack portion having lock detents 54 and 54' therein, which cooperate with the shoulder locks 32 and 32' when the adaptor 10 is assembled, and the modular plug 12 extending outwardly from the backwall 52. The plug 12 divides the backwall 52 into an upwardly extending first jack backwall 56 and a downwardly extending second jack backwall 58. The external face 60 of the first jack backwall 56 has a plurality of spaced-apart parallel channels 62 therein for the conductor members 28.

The internal face 64 of the first jack backwall 56 has a first conductor support 66 that has a plurality of spaced-apart parallel channels 68 therein for the conductor members 28 and a first conductor retainer 70. The channels 68 pass through openings 72 in the first jack backwall 56 and are contiguous with the corresponding channels 62 in the external face 60 of the first back backwall 56. The internal face 74 of the second jack backwall 58 has a second conductor support 76 having spaced-apart parallel channels 78 therein for the conductor members 28. The channels 78 pass through the openings 80 in the second jack backwall 58.

The upper surface 82 of the modular plug 12 has spaced-apart parallel channels 84 for conductor members 28 that are contiguous to channels 62 in the first jack backwall 56 and channels 78 in the second conductor support 76. Corresponding channels on the first conductor support 66, the external backwall 56, the upper surface 82 of the plug 12 and the second conductor support 76 lie in the same plane.

The conductor 28 is comprised of a first jack conductor portion 86, a first connecting portion 88, an intermediate portion 90, a second connecting portion 92, and a second jack contact portion 94. The first connecting portion 88 has a first bend 96 and a second bend 98 that divide the first connecting portion 88 into a vertical first section 100 and a horizontal second section 102. The intermediate portion 90 of the conductor 28 has a reversed fold 104 that creates a first parallel section 106 and a second parallel section 108 in that portion of the conductor 28. The intermediate portion 90 further has a plug contact portion 110 in the first parallel section 106. The second connecting portion 92 extends from the second parallel section 108 of the intermediate portion 90 to the second jack contact portion 94. The first jack contact portion 86, the plug contact portion 110 and the second jack contact portion 94 have localized bands of gold plating thereon at 112, 114, and 116 respectively.

Figures 3, 4, 5, 6:
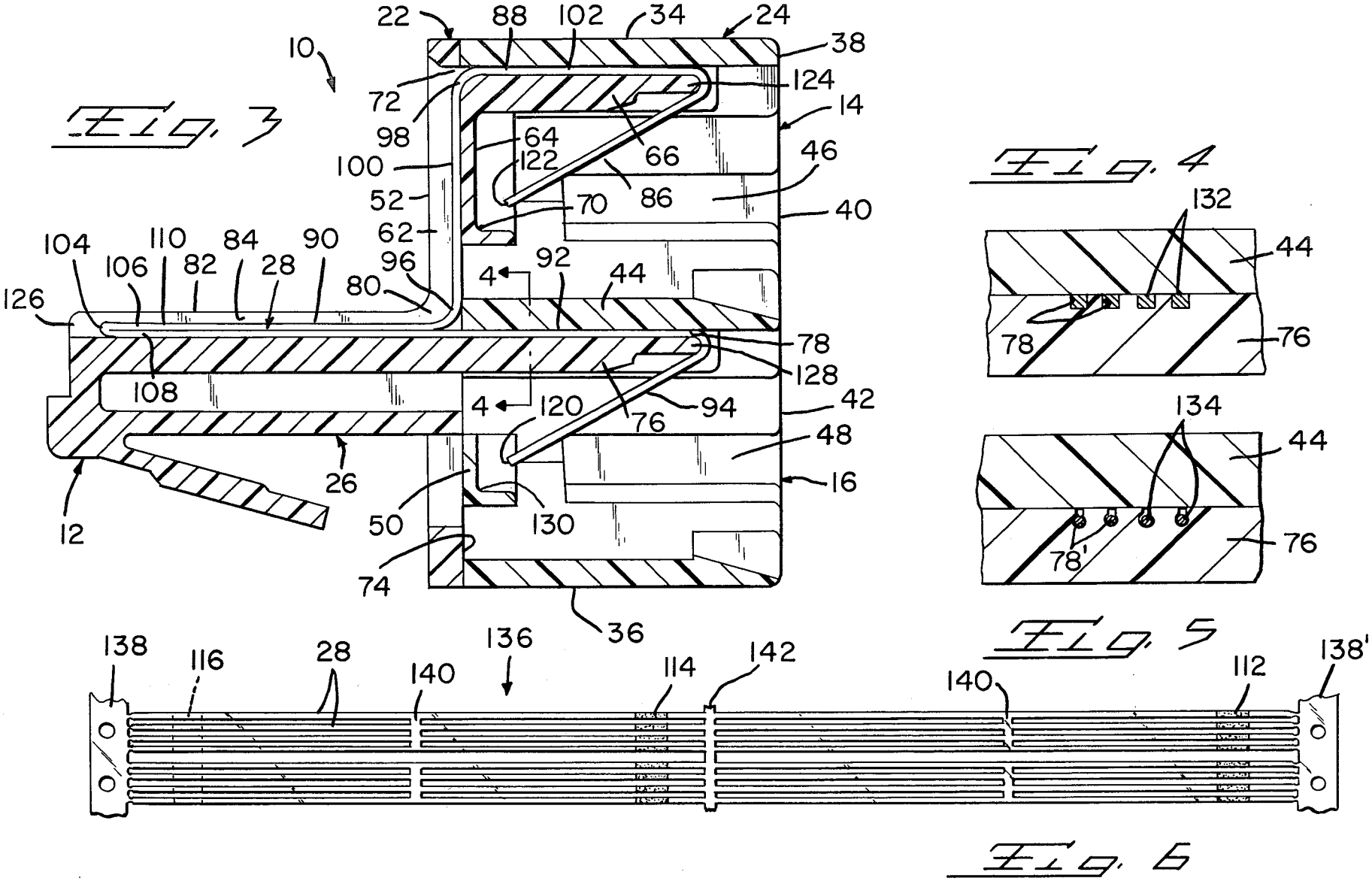
FIG. 3 is a cross-sectional view of the assembled adaptor taken along the line 3—3 of FIG. 1.
FIG. 4 is a cross-sectional view of the assembled adaptor taken along the line 4—4 of FIG. 3 showing a fragmentary cross-sectional view of stamped and formed conductor members.
FIG. 5 is a view similar to FIG. 4 showing an alternate embodiment, in that the connector members are uninsulated wire.
FIG. 6 is a plan view of a strip of stamped conductor members.

As is illustrated by FIGS. 2 and 3, the adaptor 10 is assembled by first inserting the conductor members 28 into the plug portion 12 of the housing 22 and then inserting the conductor plug unit 118 into the jack portion 24 of the housing 22.

In assembling the conductor plug unit 118, the leading ends 120 of the second jack contact portions 94 are first inserted into the channels 84 on the upper surface 82 of the modular plug 12 and then into and through the openings 80 in the backwall 58 of the second modular jack 16. Simultaneously, as the ends 120 enter the openings 80, the leading ends 122 of the first jack contact portion 86 are inserted into and through the openings 72 in the backwall 56 of the first modular jack 14. The conductor members 28 are pushed into the plug portion 12 until the vertical first section 100 of the first connecting portion 88 is seated in the channels 62 in the external face 60 of the backwall 56 of the first modular jack. When this position is attained, the first jack contact portions 86 of the conductor members 28 extend beyond the end 124 of the first conductor support 66, the horizontal second sections 102 of the first connecting portion 88 of the conductor members 28 are seated in the channels 68 of the first conductor support 66, the first and second parallel sections 106 and 108 respectively are seated in the channels 84 in the upper surface 82 of the modular plug 12 with the reverse folds 104 at the end 126 of the plug 12, the second connecting portions 92 of the conductor members 28 are seated in the channels 78 of the second conductor support 76, and the second jack contact portions 94 extend beyond the end 128 of the second conductor support 76. The first jack contact portions 86 are then reversely bent around the end 124 of the first conductor support 66 until the jack contact ends 122 are engaged in the first contact retainer 70. In a like manner, the second jack contact portions 94 are reversely bent around the end 128 of the second support 76.

The assembled conductor plug unit 118 is then joined to the jack portion 24 of the housing 22 by inserting the first and second conductor supports 66 and 76 into the corresponding jack cavities 46 and 48 until the second jack contact ends 120 are engaged in the second contact retainer 130 and the locking shoulders 32 and 32' are engaged with the lock detents 54 and 54'. FIG. 3 shows a cross-sectional view of an assembled adaptor.

Referring now to FIG. 1, as well as to FIG. 3, when the additional plugs 20 and 20' are inserted into the first and second modular jack cavities 46 and 48 respectively, the contact portion of the additional modular plugs 20 and 20' engage with the corresponding jack contact portions 86 and 94 of conductor members 28. When the modular plug 12 is inserted into the additional modular jack 18, the plug contact portion 110 engages with the corresponding jack contacts in the modular jack 18.

FIG. 4 illustrates a fragmentary cross-sectional view of the internal separating wall 44 and the second conductor support 76 with the channels 78 containing stamped and formed conductor members 132.

FIG. 5 illustrates the same fragmentary cross-sectional view of the internal separating wall 44 and the second conductor support 76 with the channels 78' containing uninsulated wire conductor members 134.

FIG. 6 illustrates a strip 136 of stamped conductor members 28 having carrier strips 138 and 138' at each end. The conductor members 28 are further joined by inner support strips 140 between groups of conductor members 28 and an intermediate support strip 142 connecting all of the conductor members during the stamping and plating processes. The inner support carrier strip 126 and the intermediate support strips 142 are all removed prior to assembling the adaptor 10, as described above.

FIG. 6 further illustrates the localized bands of gold plating 112 on the first jack contact portions 86, the localized bands of gold plating 114 on the plug contact portions 110 and the localized bands of gold plating 116 on the second jack contact portions 94.

What is claimed is:

1. A modular plug-dual modular jack adaptor of the type comprising a first modular plug and first and second modular jacks, the modular jacks having plug-receiving faces which lie in a common plane and having backwalls which lie in a common plane which is substantially parallel to, and spaced from, the common plane of the plug-receiving faces, the modular plug extending from the common plane of the backwalls of the modular jacks, a plurality of conductors, each conductor having a first jack contact portion in the first modular jack, a first connecting portion extending from the first modular jack to the modular plug and having an intermediate portion in the modular plug, the intermediate portion being reversely bent upon itself and forming a plug contact in the modular plug, a second connecting portion extending from the intermediate portion to the second modular jack, and a second jack portion in the second modular jack, the adaptor being characterized in that:

the first and second modular jacks are side-by-side with the corresponding first and second jack contacts in the first and second modular jacks lying in the same plane, each of the conductors is a continuous one-piece uninsulated conductive member, the intermediate portion comprising first and second parallel sections in the modular plug which extends from the reverse bend to the rearward end of the modular plug, the first connecting portion extending normally from the first parallel section across the back wall of the first modular jack, the first connecting portion being bent intermediate its ends and extending through the back wall of the first modular jack and into the first modular jack, the second connecting portion extending as a straight line extension of the second parallel section through the back wall of the second modular jack and into the second modular jack whereby, upon mating the modular plug of the adaptor with an additional modular jack and plugging additional modular plugs into the first and second modular jacks, the conductors in the additional modular jacks are connected to the corresponding conductors in the additional modular plugs.

2. A modular plug-dual modular jack adaptor as set forth in claim 1 characterized in that the conductors are stamped and formed from sheet metal.

3. A modular plug-dual modular jack adaptor as set forth in claims 1 or 2 characterized in that the back wall of the first and second modular jacks are integral with, and extend normally and in opposite directions from the modular plug.

4. A modular plug-dual modular jack adaptor as set forth in claim 3 characterized in that the first and second modular jack back walls have first and second conductor supports extending therefrom in the direction opposite to the direction of the modular plug, the first and second conductor supports being received within the first and second modular jacks, the first connecting portions of the conductors being supported on the first conductor support portions and the second connecting portions of the conductors being supported on the second conductor support.

5. A modular plug-dual modular jack adaptor as set forth in claim 4 characterized in that the conductor supports have spaced-apart parallel channels therein, the connecting portions of the conductors being in the channels.

6. A modular plug-dual modular jack adaptor as set forth in claim 3 characterized in that the modular jack back walls are held in assembled relationship to the modular jacks by interengaging latching means.

7. A modular plug-dual modular jack adaptor as set forth in claim 4 characterized in that the modular jack back walls are held in assembled relationship to the modular jacks by interengaging latching means.

8. A modular plug-dual modular jack adaptor as set forth in claim 5 characterized in that the modular jack backwalls are held in assembled relationship to the modular jack by interengaging latching means.

9. A modular plug-dual modular jack adaptor as set forth in claim 2 characterized in that the conductors have localized bands of a precious metal plated on the contact portion of the first and second jack contact portions and on the contact portion of the plug contact.

10. A modular plug-dual modular jack adaptor as set forth in claim 9 further characterized in that the precious metal is gold.

* * * * *